United States Patent [19]

Del Vecchio

[11] 4,055,892

[45] Nov. 1, 1977

[54] FOOD DICER

[76] Inventor: Joseph Del Vecchio, 3206 Middletown Road, Bronx, N.Y. 10465

[21] Appl. No.: 665,693

[22] Filed: Mar. 10, 1976

[51] Int. Cl.[2] ..... B26B 3/00

[52] U.S. Cl. ..... 30/303; 30/305; 83/157; 83/167

[58] Field of Search ..... 30/299, 303, 305, 315, 30/316, 124; 83/599, 157, 167

[56] References Cited

U.S. PATENT DOCUMENTS

| | | | |
|---|---|---|---|
| 1,877,105 | 9/1932 | Wilkerson | 83/599 |

FOREIGN PATENT DOCUMENTS

| | | | |
|---|---|---|---|
| 695,856 | 10/1930 | France | 83/599 |
| 564,523 | 1/1957 | Italy | 30/305 |

*Primary Examiner*—James L. Jones, Jr.
*Attorney, Agent, or Firm*—Eugene V. Mandel

[57] ABSTRACT

A food dicer with a hinged cutting cover and a slideout bottom.

4 Claims, 2 Drawing Figures

FOOD DICER

BACKGROUND OF THE INVENTION

1. Field of the Invention

This invention relates to food cutters and, in particular, multibladed simultaneous cutters. It applies more particularly to dicing type cutters.

2. Description of the Prior Art

Multibladed cutters have long been used to act simultaneously. Known devices include Klegnas' cutter disclosed in U.S. Pat. No. 2,502,157 issued Mar. 28, 1950, Hellenbrand's much earlier cutter disclosed in U.S. Pat. No. 272,252 issued Feb. 13, 1883; and Haynes' cutter in U.S. Pat. No. 1,979,199 issued Oct. 30, 1934.

SUMMARY OF THE INVENTION

It is therefore an object of this invention to overcome the limitations and disadvantages in the food dicing devices in the prior art and currently available in the market.

One of the objects of the invention is to provide a food dicing device embodying improved principles of design and construction.

An important object of the invention is to provide a food dicing device which is comprised of simple durable parts and components which can be economically manufactured and readily assembled.

A significant object of the invention is to provide a food dicing device, so designed and constructed that it can be easily applied to almost any typical soft food now in use.

Another object of the invention is to provide a relatively safe food dicer having a limited opening.

A further object of the invention is to provide a food dicer small enough to be easily storable and therefore readily accessible.

Yet another object of the invention is to provide a food dicer which can be used to retain the diced pieces and to permit easy distribution of the pieces over a suitable area.

Further objects and advantages of this invention will appear more clearly from the following description of a non-limiting illustrative embodiment and the accompanying drawings in which like numerals designate like parts thruout the several views.

Briefly summarized, a preferred embodiment of the invention is described in conjunction with an illustrative disclosure thereof in the accompanying drawings, in which.

DESCRIPTION OF TYPICAL EMBODIMENT

Figure 1:
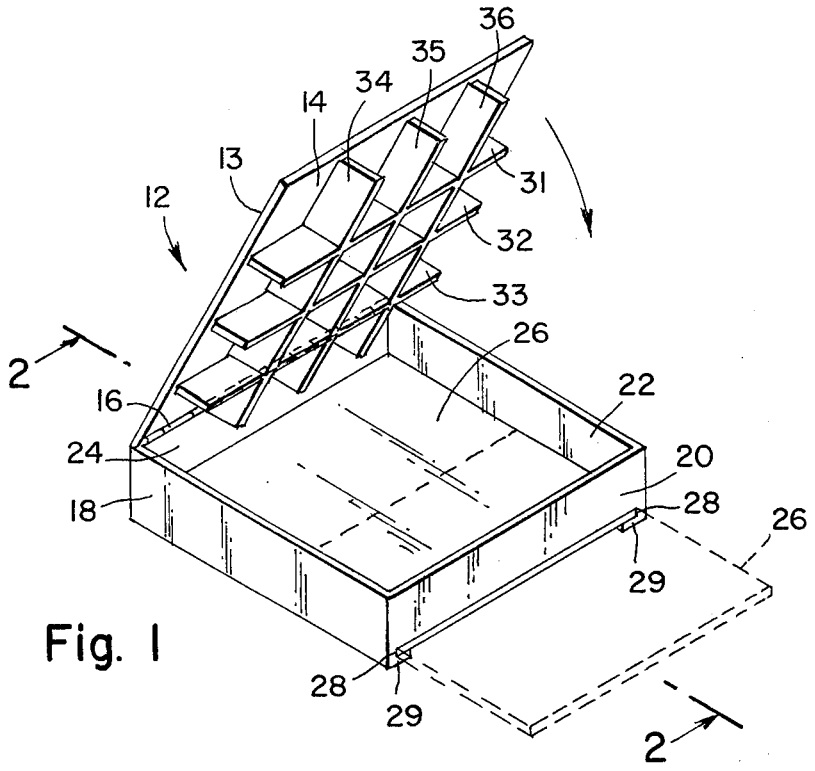
FIG. 1 is a pictorial representation of the food dicer constructed according to the principles of this invention.
Figure 2:
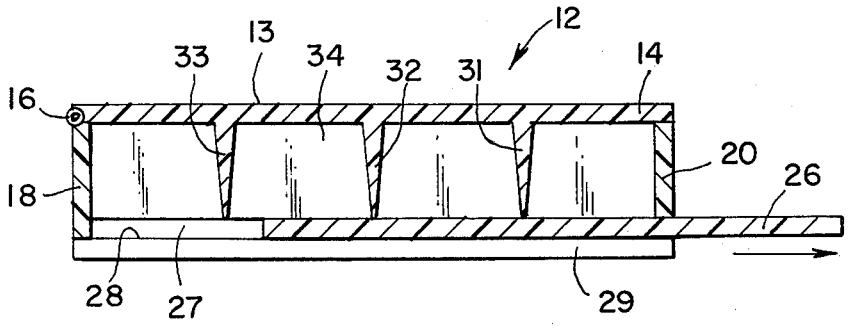
FIG. 2 is a cross sectional elevation taken substantially along line 2—2 in FIG. 1.

In the drawings a food dicer 12 embodying features of the invention is illustrated comprising a body 18, 20, 22, 24 to which is lungedly 16 attached a cover 14 provided with multiple cutters 31, 32, 33, 34, 35, 36 to permit simultaneous cutting, in effect, dicing.

In the dicer 12 as illustrated in FIG. 1, the soft food or the like such as jello is placed inside the body 18, 20, 22, 24 on top of the bottom 26 which is a board slidable in grooves 28 formed by lips in the body 29 and which, as it is slid out, creates an increasing opening 28 which permits the diced food pieces to be released as desired thru the opened bottom.

The cover 14 is comprised of an upper surface 13 to which to which is affixed transverse cutters such as 31, 32, 33, 34, 35, 36, which may be arranged in any desired cutting pattern. The cutters may be integral with the upper surface 13, or may be separate pieces suitably attached, or may even be comprised of extended ribs to the tips of which cutting blades may be attached.

By limiting the opening swing of the cover 12, safety of this device is increased.

The device may be built up of separate pieces, or may be made in a few as two parts — the sliding bottom and a molded plastic piece comprising the body and the cover including the blades.

The device may be made by known manufacturing methods of suitable materials including metals, plastics and wood.

From the foregoing, the construction and operation of the device will be readily understood and further explanation is beleived superfluous.

The invention includes all novelty residing in the description and drawings. It is obvious to those skilled in the art that various minor changes can be made without departing from the concept of this invention and all such as fall within the reasonable scope of the appended claims are included.

What is claimed is:

1. A food dicer which may be used for jello and the like comprising a body to which is hingedly attached a cover provided with a plurality of cutting blades suitably arranged in the desired cutting pattern, the body comprised of several joined side walls to which is slidably fitted a remobable bottom; so that when the item to be cut is placed on the bottom within the body and the cover is swung towards the bottom — the item becomes cut; and so that the cut small items can be released as the bottom is slidably removed.

2. A food dicer as in claim 1 wherein the body is made in one piece.

3. A food dicer as in claim 1 wherein the cutting blades are integral with the cover.

4. A food dicer as in claim 1 wherein the body, hinge, cover and cutting blades are made in one piece.

* * * * *